United States Patent [19]

Ito

[11] 4,030,212

[45] June 21, 1977

[54] ONE-PIECE SANDAL MADE FROM A FLAT SHEET

[75] Inventor: Kakutaro Ito, Kobe, Japan

[73] Assignees: Kakutaro Ito; Yuzoh Katoh, both of Kobe, Japan

[22] Filed: Aug. 26, 1976

[21] Appl. No.: 717,571

[52] U.S. Cl. ..... 36/11.5; 12/142 S

[51] Int. Cl.[2] ..... A43B 3/12; A43D 9/00

[58] Field of Search ..... 36/11.5, 8.1, 104, 9 R, 36/83; 12/142 S, 142 R

[56] References Cited

UNITED STATES PATENTS 3,404,469 10/1968 Prenovitz ..... 36/11.5

3,775,873 12/1973 Small ..... 36/11.5

FOREIGN PATENTS OR APPLICATIONS 1,000,524 2/1952 France ..... 36/11.5

*Primary Examiner*—Patrick D. Lawson

[57] ABSTRACT

A sandal made from a single flat sheet of relatively soft and resilient material characterized in that two separate portions of the sheet are partially cut away so that their movable ends may be bent upwardly and releasably interengaged, the remaining flat portion of the sheet then providing the sole member of a sandal while the upwardly bent portions provide strap means for retaining the sandal upon the foot of a wearer.

14 Claims, 4 Drawing Figures

ONE-PIECE SANDAL MADE FROM A FLAT SHEET

BACKGROUND OF THE INVENTION

There is a heavy demand for low-cost sandals particularly in the relatively warm areas of the world. Many types and styles of low-cost sandals have been devised and sold heretofore. Nevertheless, there is always room for further improvement.

The present invention is directed toward the manufacture of sandals using relatively low-cost material and high-production machinery, and towards devising a product which eliminates the need for hand labor in the manufacturing process.

SUMMARY OF THE INVENTION

The present invention provides a sandal made from a single flat sheet of relatively soft and resilient material, with the sandal being manufactured and sold in the form of a flat sheet so that it is easily and economically handled, stored, and transported. In the manufacturing process the flat sheet is cut to an appropriate shape so as to provide a sole member that extends underneath both the heel and toes of a wearer's foot, with additional portions of the flat sheet being partially cut away from the sole member so that the buyer, after purchasing the sandal, may bend the cutaway portions of the sheet upwardly and secure them together to provide the strap means of the sandal.

More specifically, at the forward end of the flat sheet a stem portion is cut away from the sole member near the lateral center of its toe portion, while at the rearward end of the flat sheet a loop portion which extends around the outside of the heel of the sole member is cut away, so that the forward end of the stem portion and the rearward end of the loop portion may be bent upwardly and towards each other. The forward end of the stem portion is provided with protruberance or hook, while the center of the loop portion is provided with a notch that is adapted to releasably retain the hook. Therefore, the stem portion and loop portion, when bent upwardly from the sole member and latched together, provide strap means for supporting the sandal upon the foot of a wearer.

Both the stem portion and the loop portion are cut away from the sole member along a pair of generally parallel lines. However, the longitudinally inward ends of the lines are curved so as to terminate in an essentially lateral direction, in order to minimize tearing action caused by a pulling force on the strap means.

DRAWING SUMMARY

DETAILED DESCRIPTION

Figure 1:
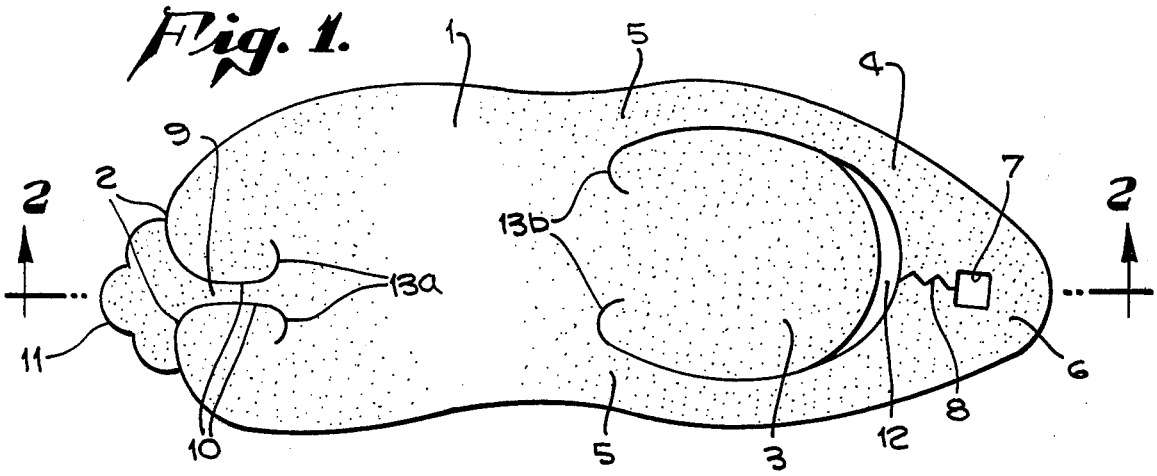
FIG. 1 is a plan view of the sandal in accordance with the present invention, after it has been manufactured.
Figure 2:
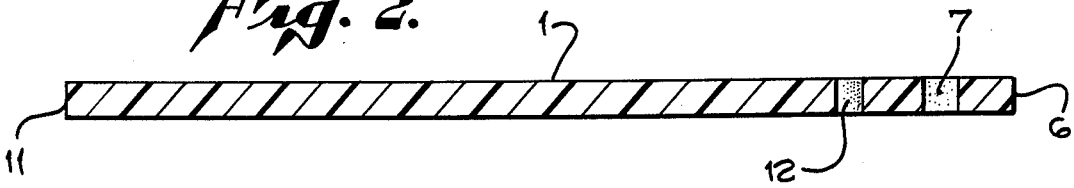
FIG. 2 is a longitudinal cross-sectional elevation view taken on the line 2—2 of FIG. 1.
Figure 3:
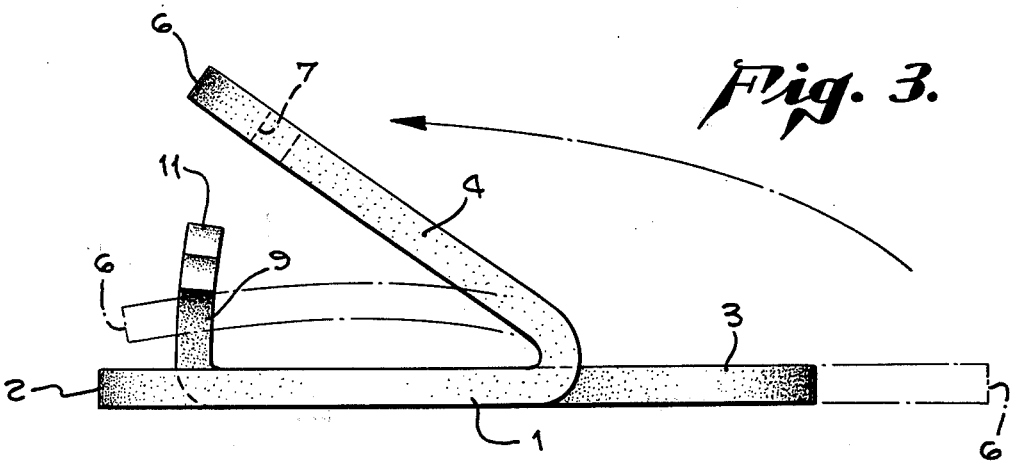
FIG. 3 is a side elevation view of the sandal showing the upwardly bent position of the strap means.
Figure 4:
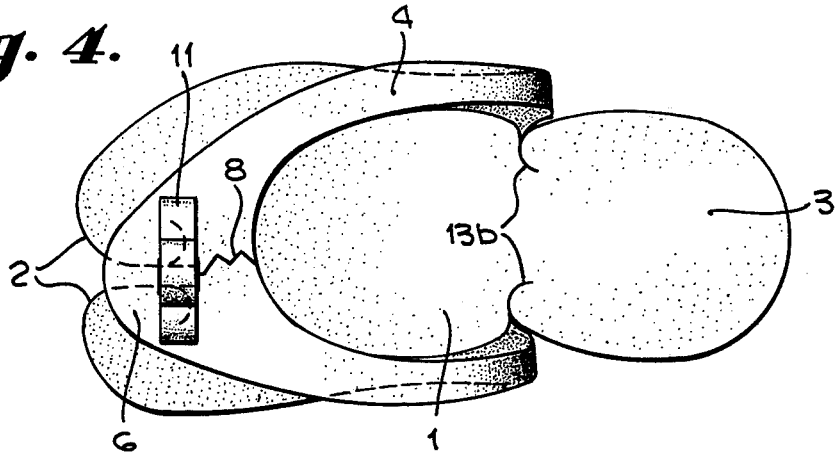
FIG. 4 is a top plan view of the completed sandal, after the strap means have been latched together.

Reference is now made to the drawings in which FIGS. 1 and 2 illustrate the sandal of the present invention as it comes from the factory, FIG. 3 shows the strap portions being bent away from the sole member of the sandal, and FIG. 4 shows the strap portions latched together so that the sandal is ready to be worn.

The flat sheet member 1 is of uniform thickness throughout, and made of a relatively soft and resilient material. For example, the sheet 1 may be made of a foam plastic material or the like. Although not illustrated in the present drawings, it is preferred to make the sheet member 1 as a laminated structure which includes a relatively hard layer on the bottom and a relatively soft layer on the top. A typical value for the thickness of sheet 1 is three-eighths inch for a child's sandal, or somewhat more for the sandal of an adult person.

The sheet member 1 is cut to proper size to provide a toe portion 2 and a heel portion 3. The configuration of these parts is best seen in FIG. 4 of the drawing. The toe portion 2, heel portion 3, and intervening portion of the sheet 1 provide a sole member for the sandal.

At the rearward end of the sandal a loop portion 4, which extends about the heel portion 3, is cut away from the heel portion along generally parallel lines 12. However, at the rearward extremity of the heel portion 3 a crescent-shaped piece of the sheet member 1 is cut out so as to leave a crescent-shaped gap or opening between the heel 3 and loop 4. See FIG. 1. The forward ends 5 of loop 4 remain fixed to the sole member, on opposite sides of the heel portion 3. The parallel lines 12, at their forward or longitudinally inward ends, are curved laterally inwardly at **13*b* and are then further curved to extend somewhat rearwardly. The purpose of the curved ends 13*b* of the cutting lines is to minimize or avoid tearing action that would otherwise be caused by lifting up the loop 4** and bending it away from the sole member.

The rearward extremity of the loop portion 4 is designated 6, and its dimension in the longitudinal direction of the sandal is about two or three times the width of the loop portion 4 at the lateral sides of the heel 3. A notch 7, preferably square as illustrated, is cut approximately in the center of the loop end 6. Thus, a corresponding square piece of the sheet member 1 is removed in the manufacturing process. A cut line 8 is also made in the loop portion 4 which communicates between the open notch 7 and the crescent-shaped opening formed by the cutting lines 12.

At the forward end of the sandal a stem portion 9 is at about the lateral center of the toe portion 2 of the sandal. The particular sandal illustrated herein is for the right foot of the wearer, and since stem portion 9 when bent upwardly occupies the space between big toe and next toe of the wearer, the width of that part of the toe portion 2 which lies on the left side of the stem 9 (lower left corner of FIGS. 1 and 4) is somewhat narrower than the width of that part of the toe portion 2 which lies on the right side thereof (upper left corner of FIGS. 1 and 4). Stem 9 is cut from the toe portion 2 along a generally parallel pair of cutting lines 10. At its forward extremity the forward stem 9 is enlarged to form a protruberance or hook 11. At the inner or rearward end of the stem 9 the cutting lines 10 are curved laterally outward, and are further curved to extend slightly forwardly at their terminating points. These curved ends **13*a* of the lines 10 are provided in order to minimize or avoid the tearing action that would otherwise result when the stem 9** is bent upwardly from the sole member.

When the sandal is to be worn, the forward stem 9 is bent upwardly and rearwardly through an angle of about 95° as shown in FIG. 3. As there shown, most of the bending action occurs in the region of the curved line ends 13*a*. The rearward portion 6 of the loop 4 is bent upwardly and forwardly throughout an angle of about 160°. FIG. 3 shows the loop 4 in said lines at the point where the bending of the loop has been nearly completed. FIG. 3 shows the loop end 6 in dotted lines after the bending is fully completed. From the dotted line portion of FIG. 3 it will be seen that in the assembled form of the sandal the rearward end 6 of the loop 4 lies approximately parallel to the toe portion 2 of the sole member, and somewhat above it, with the bending action of the loop taking place primarily at or fairly close to the location of the curved line ends 13*b*.

The protruberance or hook 11 is, of course, much too large to pass through the notch 7. The loop portion 6 is therefore bent and manipulated to separate it along the cutting line 8, permitting the relatively narrow portion of the stem 9 to be passed through the gap thus provided, so that the relatively narrow portion of stem 9 then occupies the notch 7 in perpendicularly extending relationship to the extremity 6 of the loop portion 4, while the protruberance or hook 11 extends above it. This assembled condition of the sandal, illustrated by the dotted lines in FIG. 3, is shown in a top view in solid lines in FIG. 4.

When the foot of the wearer is placed upon the sole member, the big toe then passes to one side of the stem 9 while the other toes pass to the other side thereof, all of the toes resting upon the toe portion 2. The loop portion 4 then lies above the forward portion of the wearer's foot (not specifically shown), extending laterally across the foot above most of the area of the toe joints and then extending rearwardly on the laterally opposite sides of the foot. The loop 4 and stem 9, being securely but releasably fastened together, cooperatively provide a strap means for holding the sandal upon the foot of the wearer.

The cutting line 8 is preferably cut in a saw-tooth configuration, as shown, in order to more securely hold the stem 9 within the notch 7, when the sandal is being worn.

When the sandal is being worn, the stem 9 and loop 4 are preferably detached from each other, and bent downward to the original flat configuration, and a pair of the sandals may then be conveniently stored in the same small space that they occupied when they were originally purchased.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A one-piece sandal made from a flat sheet of relatively soft, resilient material, characterized in that:

said sheet forms a sole member of such size and shape as to extend underneath both the heel and toes of a wearer's foot, said sheet also having two further extending portions which are partially cut away from said sole member such that one end of each said portion remains integral with said sole member while the other end thereof is movable relative to said sole member;

said two further extending sheet portions being adapted to form strap means extending above said sole member just rearwardly of the toe portion thereof;

said movable ends of said two sheet portions also being of such configuration as to cooperatively form latch means for releasably securing the same together.

2. A one-piece sandal made from a flat sheet of relatively soft, resilient material, characterized in that:

said sheet forms a sole member of such size and shape as to extend underneath both the heel and toes of a wearer's foot, said sheet also having a forwardly extending stem portion whose rearward end is secured to said sole member as an integral part thereof, said sheet also having a rearwardly extending loop portion whose forward ends are secured to said sole member as an integral part thereof;

the forward end of said stem portion and the rearward end of said loop portion being movable upwardly relative to said sole member, and having latch means formed thereon for releasably securing the same together;

said stem portion and said loop portion then cooperatively forming strap means which extends over the foot of the wearer at a location rearwardly of the toe portion of said sole member.

3. A sandal as in claim 2 wherein forward ends of said loop portion are secured to opposite sides of said sole member near the heel portion thereof, and in the wearing position of said sandal the rearward end of said loop portion is bent forwardly above said sole member to said location rearwardly of the toe portion.

4. A sandal as in claim 2 wherein said stem portion is cut away from said sole member near the lateral center of the toe portion thereof and along a pair of generally parallel lines, and in the wearing position of said sandal its forward end is bent rearwardly above said sole member to said location rearwardly of the toe portion.

5. A sandal as in claim 2 wherein said stem portion is provided with a hook and said loop portion is provided with a notch adapted to releasably retain said hook.

6. A sandal as in claim 2 wherein both said stem portion and said loop portion are cut away from said sole member along a pair of generally parallel lines, the longitudinally inward ends of said lines being curved so as to terminate in an essentially lateral direction, so that the tendency of said lines to be extended by a tearing action in response to a pulling force on said strap means is minimized.

7. A sandal as in claim 3 wherein said stem portion is cut away from said sole member near the lateral center of the toe portion thereof and along a pair of generally parallel lines, and in the wearing position of said sandal its forward end is bent rearwardly above said sole member to said location rearwardly of the toe portion.

8. A sandal as in claim 3 wherein said stem portion is provided with a hook and said loop portion is provided with a notch adapted to releasably retain said hook.

9. A sandal as in claim 5 wherein both said stem portion and said loop portion are cut away from said sole member along a pair of generally parallel lines, the longitudinally inward ends of said lines being curved so as to terminate in an essentially lateral direction, so that the tendency of said lines to be extended by a tearing action in response to a pulling force on said strap means is minimized.

10. A sandal as in claim 7 wherein said stem portion is provided with a hook and said loop portion is provided with a notch adapted to releasably retain said hook.

11. A sandal as in claim 7 wherein both said stem portion and said loop portion are cut away from said sole member along a pair of generally parallel lines, the longitudinally inward ends of said lines being curved so as to terminate in an essentially lateral direction, so that the tendency of said lines to be extended by a tearing action in reponse to a pulling force on said strap means is minimized.

12. A sandal as in claim 11 wherein said stem portion is provided with a hook and said loop portion is provided with a notch adapted to releasably retain said hook.

13. The method of manufacturing a sandal from a single flat sheet of relatively soft, resilient material, comprising the steps of:

cutting the sheet to about the configuration of the under side of the wearer's foot, but with some longitudinally forward and longitudinally rearward extension thereof;

cutting the forward extension partially away from the remainder of the sheet so that it has an enlarged forward extremity which can be bent upwardly relative to the sheet; and cutting the sheet along the lateral sides and around the rearward edge of the heel portion thereof to provide a loop of material, and also cutting a notch in the lateral center of said loop;

so that said stem and said loop may then be bent towards each other and releasably latched together for forming a strap means for the sandal.

14. The method of manufacturing a sandal from a single sheet of relatively soft and resilient material, comprising the steps of:

trimming the sheet to provide a sole portion of such size and configuration as to fit beneath the foot of the wearer, together with two extending portions;

partially cutting each of the extending portions away from the sole portion along a pair of generally parallel lines, so that the outward end of said extending portion may be bent upwardly relative to the sole portion; and trimming the outward ends of said extending portions so that, when bent upwardly towards each other, they are adapted to be releasably fastened together.

* * * * *